US005858913A

United States Patent [19]

Dewanckele et al.

[11] Patent Number: 5,858,913

[45] **Date of Patent: *Jan. 12, 1999**

[54] RECEIVING ELEMENT FOR USE IN THERMAL TRANSFER PRINTING

[75] Inventors: Jean-Marie Dewanckele, Drongen; Geert Defieuw, Kessel-Lo; Marcel Monbaliu, Mortsel; Wilhelmus Janssens, Aarschot, all of Belgium

[73] Assignee: Agfa-Gevaert, Mortsel, Belgium

[ * ] Notice: The term of this patent shall not extend beyond the expiration date of Pat. No. 5,547,809.

[21] Appl. No.: 543,224

[22] Filed: Oct. 13, 1995

[30] Foreign Application Priority Data

Oct. 14, 1994 [EP] European Pat. Off. ..... 94202981

[51] Int. Cl.[6] ..... B41M 5/32

[52] U.S. Cl. ..... 503/201; 503/202; 503/209; 503/210; 503/216; 503/217; 503/226

[58] Field of Search ..... 503/202, 210, 503/216, 217, 226, 201, 209; 430/200, 338, 567, 608, 619; 427/150–152

[56] References Cited

U.S. PATENT DOCUMENTS

| | | | |
|---|---|---|---|
| 2,910,377 | 10/1959 | Owen | 117/36 |
| 3,028,254 | 4/1962 | Grant | 117/36.8 |
| 3,031,329 | 4/1962 | Wingert | 117/36.8 |
| 3,107,174 | 10/1963 | Wartman | 117/36.2 |
| 3,767,414 | 10/1973 | Huffman et al. | 96/114.6 |
| 3,910,795 | 10/1975 | Shiba et al. | 96/100 |
| 3,929,486 | 12/1975 | Habu et al. | 96/76 R |
| 5,294,526 | 3/1994 | Przezdziecki et al. | 430/536 |
| 5,547,809 | 8/1996 | Defieuw et al. | 430/200 |
| 5,595,854 | 1/1997 | Leenders et al. | 430/200 |

FOREIGN PATENT DOCUMENTS

| | | | |
|---|---|---|---|
| 53-055125 | 5/1978 | Japan | 503/210 |
| 54-069435 | 4/1979 | Japan | 503/210 |
| 54-060941 | 5/1979 | Japan | 503/210 |
| 54-096054 | 7/1979 | Japan | 503/210 |
| 05319825 | 12/1993 | Japan | 503/210 |
| WOA9411198 | 5/1994 | WIPO | 503/210 |
| WOA9411199 | 5/1994 | WIPO | 503/210 |

*Primary Examiner*—Bruce H. Hess
*Attorney, Agent, or Firm*—Baker & Botts, L.L.P.

[57] ABSTRACT

Receiving element for use according to transfer printing, comprising on a support a receiving layer comprising a silver source, capable of being reduced by means of heat in the presence of a reducing agent, a binder and a stabilizer selected from the group of benzotriazoles, heterocyclic mercaptanes, sulphinic acids, 1,3,4-triazo-indolizines, 1,3-dinitroaryl compounds, 1,2,3-triazoles, phthalic acids and phthalic acid derivatives.

The receiving element provides images with higher stability at elevated temperatures and upon exposure to light.

11 Claims, No Drawings

RECEIVING ELEMENT FOR USE IN THERMAL TRANSFER PRINTING

FIELD OF THE INVENTION

The present invention relates to a thermal imaging process, more particular to a method wherein a thermotransferable reducing agent of a donor element is transferred image-wise to a receiving layer, comprising a reducible silver source and a stabiliser.

BACKGROUND OF THE INVENTION

Thermal imaging or thermography is a recording process wherein images are generated by the use of imagewise modulated thermal energy.

In thermography two approaches are known:

1. Direct thermal formation of a visible image pattern by imagewise heating of a recording material containing matter that by chemical or physical process changes colour or optical density.
2. Formation of a visible image pattern by transfer of a coloured species from an imagewise heated donor element onto a receptor element.

A survey of "direct thermal" imaging methods is given in the book "Imaging Systems" by Kurt I. Jacobson-Ralph E. Jacobson, The Focal Press—London and New York (1976), Chapter VII under the heading "7.1 Thermography". Thermography is concerned with materials which are not photosensitive, but are heat sensitive. Imagewise applied heat is sufficient to bring about a visible change in a thermosensitive imaging material.

According to a direct thermal embodiment operating by physical change, a recording material is used which contains a coloured support or support coated with a coloured layer which itself is overcoated with an opaque white light reflecting layer that can fuse to a clear, transparent state whereby the coloured support is no longer masked.. Physical thermographic systems operating with such kind of recording material are described on pages 136 and 137 of the above mentioned book of Kurt I. Jacobson et al.

A thermal imaging process described in European Patent Application nr. 94200612 and in European Patent Application 94201382 uses (i) a donor element comprising on a support a donor layer containing a binder and a thermotransferable reducing agent capable of reducing a silver source to metallic silver upon heating and (ii) a receiving element comprising on a support a receiving layer comprising a silver source capable of being reduced by means of heat in the presence of a reducing agent, said thermal imaging process comprising the steps of

- bringing said donor layer of said donor element into face to face relationship with said receiving layer of said receiving element,
- image-wise heating a thus obtained assemblage by means of a thermal head or a laser, thereby causing image-wise transfer of an amount of said thermotransferable reducing agent to said receiving element in accordance with the amount of heat supplied by said thermal head and
- separating said donor element from said receiving element.

Prints obtained with both imaging processes mentioned above obtain densities higher than 2.5. When toning agents are added to the receiving layer of the receiving elements, neutral grey tones can be obtained. A further improvement of the neutral grey tone can be achieved by adding thermotransferable dyes to the donor layer of donor element.

However, the grey tone of the image deteriorates by storage of the image at elevated temperatures (40°–60° C.) and/or by exposure to light.

OBJECT OF THE PRESENT INVENTION

It is an object of the present invention to provide a thermal imaging process wherein images are obtained with high optical densities with good stability at elevated temperatures and/or upon exposure to light.

Further objects will become apparent from the description hereinafter.

According to the present invention, there is provided a thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazoindolizines, 1,3-dinitroaryl compounds, 1,2,3-triazoles, phthalic acids and phthalic acid derivatives According to the present invention there is also provided a method for making images with the above system.

DETAILED DESCRIPTION OF THE INVENTION

A receiving element according to the present invention comprises a receiving layer provided on a support, said receiving layer comprising a silver source capable of being reduced by means of heat in the presence of a reducing agent, a binder and a stabiliser.

The reducible silver source may comprise any material that contains a reducible source of silver ions. Silver salts of organic and hetero-organic acids, particularly long chain fatty carboxylic acids (comprising from 10 to 30, preferably 15 to 25 carbon atoms) are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963 and include: salts of organic acids, e.g., gallic acid, oxalic acid, behenic acid, stearic acid, palmitic acid, lauric acid and the like; silver carboxyalkylthiourea salts, e.g., 1-(3-carboxypropyl) thiourea, 1-(3-carboxypropyl)-3,3-dimethylthiourea and the like; complexes of silver with the polymeric reaction product of an aldehyde with a hydroxy-substituted aromatic carboxylic acid, e.g., aldehydes, such as formaldehyde, acetaldehyde and butyraldehyde, and hydroxy-substituted acids, such as salicyclic acid, benzilic acid, 3,5-dihydroxybenzilic acid and 5,5-thiodisalicylic acid; silver salts or complexes of thiones, e.g., 3-(2-carboxyethyl)-4-hydroxymethyl-4-thiazoline-2-thione and 3-carboxymethyl-4-methyl-4-thiazoline-2-thione; complexes of salts of silver with nitrogen acids selected from imidazole, pyrazole, urazole, 1,2,4-triazole and 1H-tetrazole, 3-amino-5-benzylthio-1,2,4-triazole and benzotriazole; silver salts of saccharin, 5-chlorosalicylaldoxime and the like; and silver salts of mercaptides.

The preferred silver source is silver behenate.

The silver source is preferably added as a dispersion to the costing liquid of the receiving layer.

As binding agent for the heat sensitive layer preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from α, β-ethlenically unsatured compounds such as polyvinyl chloride, after chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. A polyvinyl butyral containing some vinyl alcohol units is marketed under the trade name BUTVAR B79 of Monsanto USA. Another useful polyvinyl butyral resin is S LEC BXL (Sekisui). Another interesting binder is cellulose acetate butyrate.

The binder to organic silver salt weight ratio is preferably in the range of 0.2 to 6, and the thickness of the image forming layer is preferably in the range of 5 to 16 μm.

The stabiliser useful in the present invention is selected from the group of benzotriazoles, heterocyclic mercaptanes such as e.g. 1-alkyl- or 1-aryl-5-mercaptotetrazoles, 2-alkyl-5-mercapto-1,3,4-triazoles, sulphinic acids, 1,3,4-triazoindolizines, 1,3-dinitroaryl compounds, 1,2,3-triazoles, phthalic acids and phthalic acid derivatives.

Preferred benzotriazoles correspond to the following general formula (A) or (B):

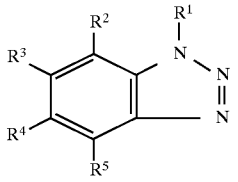

(B)

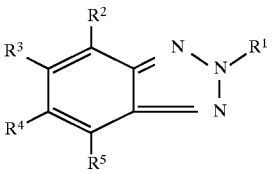

(A)

wherein:

$R^1$ represents hydrogen, an alkyl group, an alkenyl group, an aryl group, an alkylcarbonyl group, an alkenylcarboxylgroup or an arylcarbonyl group;

$R^2$ to $R^5$ each independently represent hydrogen or a substituent such as e.g. an alkyl group, an aryl group, a halogen, an alkoxy group, an aryloxy group, a hydroxy group, an alkoxy carbonyl group, an aryloxy carbonyl group etc.

Examples of suitable benzotriazoles are

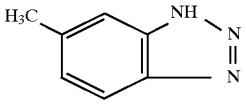

Compound I

-continued

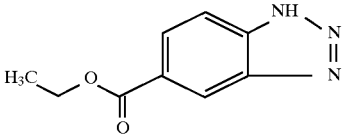

Compound II

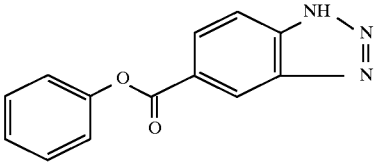

Compound III

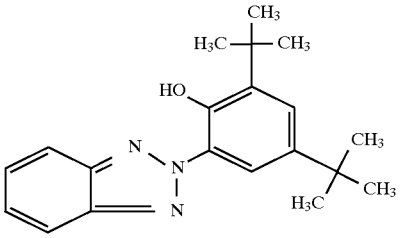

Compound IV

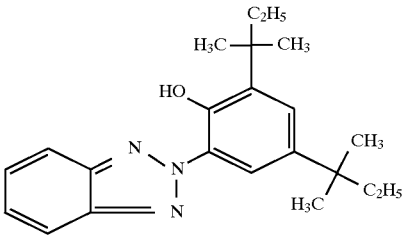

Compound V

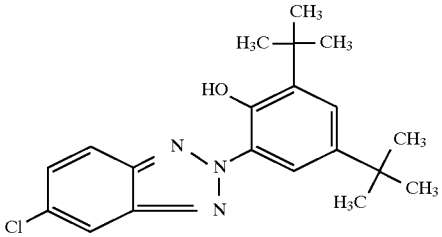

Compound VI

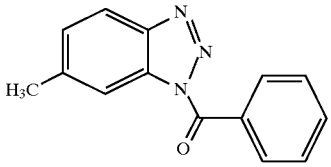

Compound VII

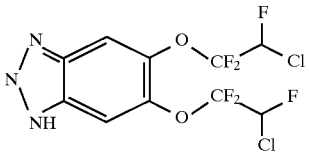

Compound VIII

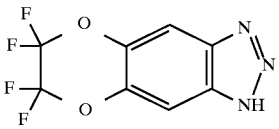

Compound IX

The use of 3,4-dialkoxy substituted benztriazoles such as compounds VIII and IX is especially preferred. Preferred heterocyclic mercaptanes are mercaptotetrazoles corresponding to the following general formula (C):

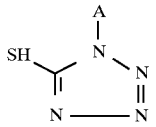

(C)

wherein A represents an alkyl group, an alkenyl group or an aryl group.

Examples of mercaptotetrazoles are

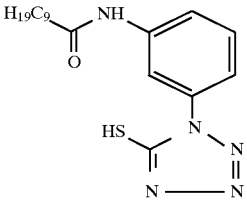

Compound X

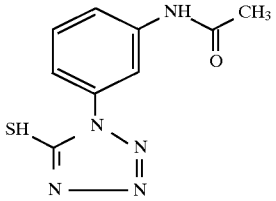

compound XI

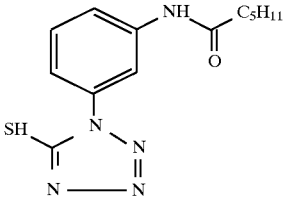

Compound XII

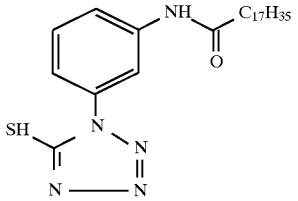

Compound XIII

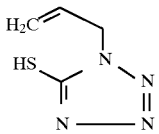

Compound XIV

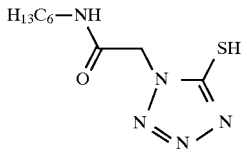

Compound XV

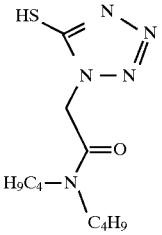

Compound XVI

-continued

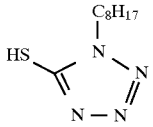

Compound XVII

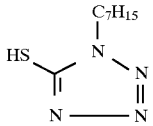

Compound XVIII

Sulphinic acids for use in connection with the present invention preferably correspond to the following formula (D):

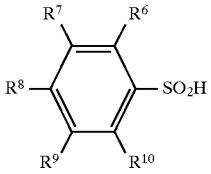

(D)

wherein each of $R^6$ to $R^{10}$ independently represent hydrogen or a substituent such as e.g. an alkyl group, an aryl group, a halogen, an alkoxy group, an aryloxy group, a hydroxy group, an alkoxy carbonyl group, an aryloxy carbonyl group, hydroxyalkyl, acylamido etc.

Examples of sulphinic acids are

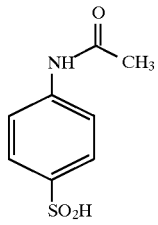

Compound XIX

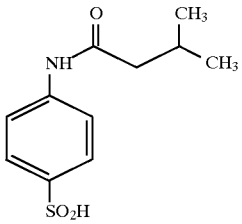

Compound XX

Preferred 1,3,4 triazoindolizines for use in the present invention preferably correspond to the following formula (E):

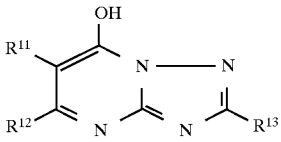

(E)

wherein each of $R^{11}$ to $R^{13}$ independently represent hydrogen or a substituent such as e.g. an alkyl group, an alkenyl group, an aryl group, a halogen, an alkoxy group, an aryloxy group, a hydroxy, an alkoxycarbonyl group, an aryloxycarbonyl group, a hydroxyalkyl group, an alkylthio group etc.

An example of a 1,3,4 triazoindolizine for use in the present invention is:

compound XXI

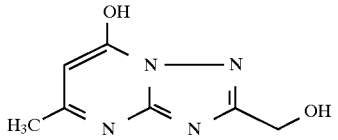

1,3-dinitroaryl compounds for use in the present invention preferably correspond to the following formula (F):

(F)

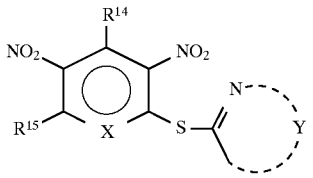

wherein X represents N or CR wherein R represents hydrogen, an alkyl or an aryl group;

Y represents the atoms necessary to complete a 5- or 6-membered heterocyclic ring and $R^{14}$, $R^{15}$ each independently represent hydrogen or a substituent such as e.g. an alkyl group, an alkenyl group, an aryl group, a halogen, an alkoxy group, an aryloxy group, an alkoxycarbonyl group, an aryloxycarbonyl group, a hydroxyalkyl group etc.

Examples of 1,3-dinitroaryl compounds for use in the present invention are:

Compound XXII

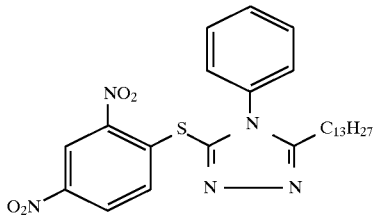

Compound XXIII

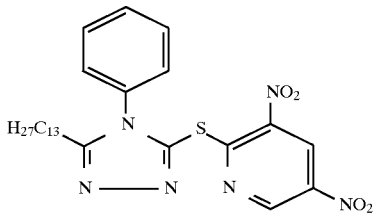

1,2,3-triazoles for use in the present invention preferably correspond to the following formula (G):

(G)

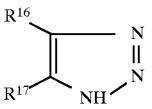

wherein $R^{16}$ and $R^{17}$ each independently represent hydrogen or a substituent such as e.g. an alkyl group, an alkenyl group, an aryl group, a halogen, an alkoxy group, an aryloxy group, a hydroxy, an alkoxycarbonyl group, an aryloxycarbonyl group, a hydroxyalkyl group, an alkylthio group etc.

An example of 1,2,3-triazoles suitable for use in connection with the present invention is Compound XXIV

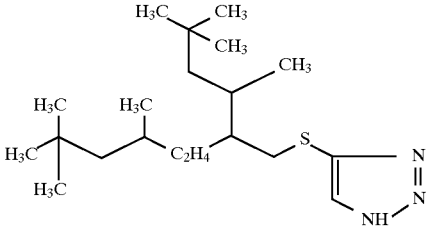

Phthalic acids and phthalic derivatives preferably correspond to the following structural formulas (H) & (I)

(H)

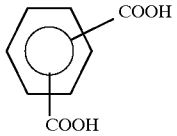

(I)

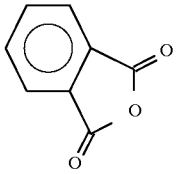

wherein the aromatic ring can be further substituted by one or more substituents such as an aryl group, an alkyl group, a halogen, an alkoxy group, an aryloxy group, a hydroxy, an alkoxy carbonyl group, an aryloxy carbonyl group and the like.

An example of a phthalic acid derivative for use in the present invention is:

Compound XXV

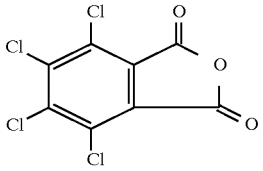

The use of benzotriazoles and more in particular 3,4-dialkoxy substituted benzotriazoles are most preferred amongst the stabilisers listed above.

A mixture of stabilisers can also be used. The stabiliser also improves the stability of the receiving element before printing.

It is preferred to use a so-called toning agent in the receiving layer or in a layer adjacent to said receiving layer. This toning agent serves to change the tone of the silver image from brown to black or grey. Suitable toning agents are e.g. phthalazinone, phthalazine, phthalimide, succinimide, phthalic acid, benzimidazole or compound T1 or derivatives thereof.

T1

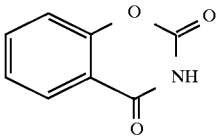

The use of phthalazinone or compound T1 or a mixture of phtalazinone and compound T1 is highly preferred.

A weak reducing agent is advantageously added to the receiving layer of the receiving element. A weak reducing agent is a reducing agent which is only capable of reducing a silver ion to metallic silver by the application of heat when nuclei of metallic silver are present.

Suitable weak reducing agents can also be found in the class of so called rubber or polymer antioxidantia e.g. sterically hindered substituted 2,2'- or 4,4'-methylenebisphenol compounds.

Preferred weak reducing agents are selected from the group of sterically hindered phenols and sterically hindered bisphenols.

Useful weak reducing agents are e.g.

R1

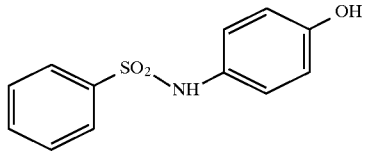

R2

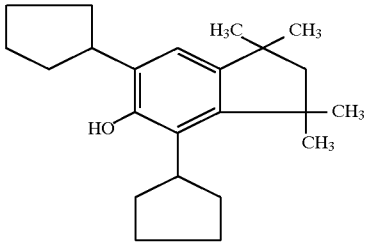

R3

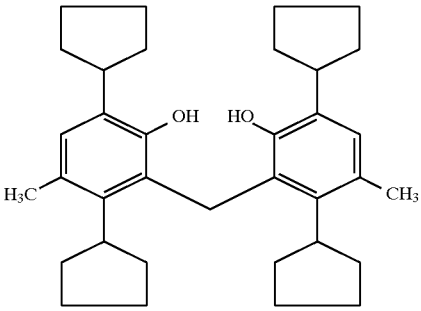

R4

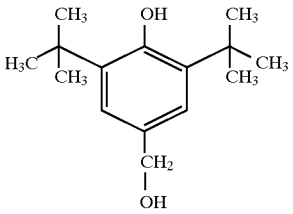

R5

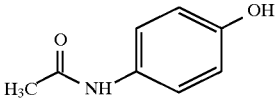

R6

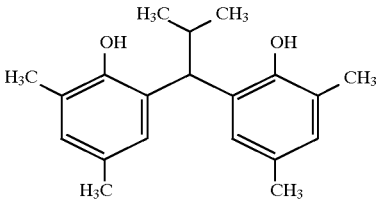

R7

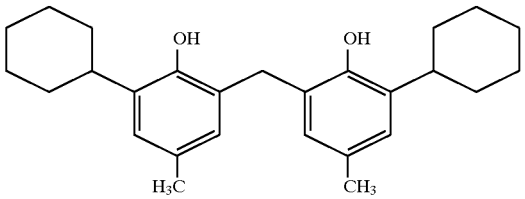

-continued

R8

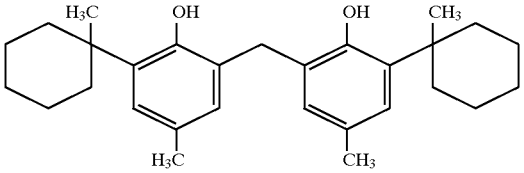

R9

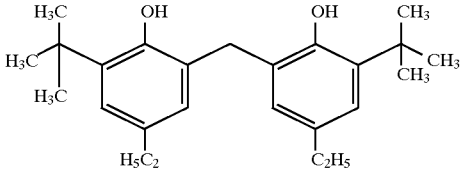

R10

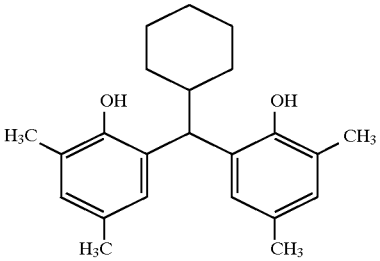

R11

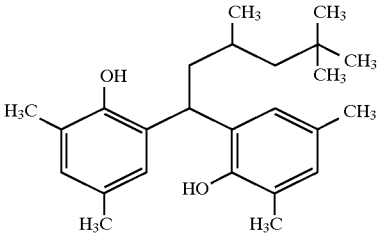

Compounds R3, R6 and R11 are especially preferred. A mixture of weak reducing agents in the image receiving layer is particularly advantageous with regard to avoiding crystallisation during storage.

It is highly preferred to use a release agent on the receiving element on the side of the receiving layer. This release agent may be added to the coating solution of the receiving layer or may be applied, optionally in a mixture with other ingredients, as a separate layer called the release layer on top of said receiving layer. The use of a release layer is preferred, since the release agent is in that case on top of the receiving element.

The release agent is preferred in the printing method of the present invention since the reducing agents useful in the present invention may give rise to a sticky contact between donor element and receiving element.

As release agents, inorganic and organic release agents can be used. Among them, the organic release agent, are preferred.

Solid waxes, fluorine- or phosphate-containing surfactants and silicone oils can be used as releasing agent. Suitable releasing agents have been described in e.g. EP 133012, JP 85/19138, and EP 227092.

When, as mentioned above, a separate release layer, incorporating the release agent, is provided on top of said receiving layer, other ingredients such as binders, plasticizers, or particulate fillers such as talc, silica or collodial particles can be added to said release layer, provided that the transfer of the reducing agent to the receiving layer comprising the reducible silver source can take place.

Examples of binders for the release layer are gelatin, dextranes polyvinylbutyral, ethylcellulose, cellulose acetate propionate, cellulose acetate butyrate, polyvinylchloride, copolymers of vinylchloride, vinylacetate and vinylalcohol, aromatic or aliphatic copolyesters, polymethylmethacrylate, polycarbonates derived from bisphenol A, polycarbonates comprising bisphenols according to formule (II) and the like. The release layer can also act as a protective layer for the images. Especially preferred release layers are mixtures of polyvinylbutyral with a silicon compound such as Tegoglide™ 410 or, mixtures of ethylcellulose with a silicon compound or mixtures of a copolymer of poly (vinylchloride-vinylacetate-vinylalcohol), a difunctional polydimethylsiloxane such as Tegomer™ HSI 2111 and a di- or multifunctional isocyanate such as Desmodur™ VL or Desmodur™ N75.

It is also possible to use a release layer which is photochemically hardened before printing or after printing (before or after the overall heat treatment mentioned below). An example of such a hardenable release layer is based on a mixture of Jaylink™ 105c (hardenable cellulose derivative manufactured by Bomar Specilities), Darocure™ 1173 (a photoinitiator manufactured by Merck), Tegoglide™ 410 (silicon based release agent manufactured by Goldschmidt) and Ebecryl™ 624 (UCB).

An adhesive layer is usually provided between the support and the receiving layer, such as those mentioned in e.g. U.S. Pat. No. 4,748,150, U.S. Pat. No. 4,954,241, U.S. Pat. No. 4,965,239 and U.S. Pat. No. 4,965,238 and EP 574055.

The subbing layer can further comprise other polymers, particles, or low molecular weight additives. Addition of inorganic particles such as silica, colloidal silica, water soluble polymers such as gelatin, polymeric latices, polystyrene sulfonic acid and polystyrene sulfonic acid sodium salt, polyvinyl pyrrolidone, surfactants such as cationic, anionic, amphoteric and non-ionic surfactants, polymeric dispersants and antistatic agents such as those mentioned in EP 440957 is preferred.

Especially preferred additives are colloidal silica, the above mentioned surfactants, butadiene containing latices such as poly(butadiene-co-methylmethacrylate-co-itaconic acid), polystyrene sulfonic acid and polystyrene sulfonic acid sodium salt. The addition of silica to the subbing layer decreases sticking on the coating roll after coating of the subbing layer. The addition of polystyrene sulfonic acid or polystyrene sulfonic acid sodium salt to the subbing layer accelerates the recycling process.

The subbing layer of the present invention is applied directly to the support of the receiving element. The subbing layer can be applied by coextrusion or can be coated on the support. Coating from aqueous solution is preferred due to its simplicity and the possibility of adding other ingredients.

The receiving layer is usually hydrophobic in order to enhance the absorption of reducing agent into the receiving element. The polyester recycling procedure, however, uses a cleaning step wherein the film waste is immersed in an alkaline or acid soap solution in water. It is an object of this cleaning process to remove all layers provided on the polymeric substrate.

In order to remove the hydrophobic receiving layer, it is highly preferred to provide an intermediate layer of a hydrophilic polymer between the subbing layer and the dye-receiving layer. This intermediate layer accelerates the cleaning step in the recycling procedure. Typical examples of hydrophilic polymers which can be used in such intermediate layers are polyvinyl alcohol, polyacrylamide, hydroxyethylcellulose, gelatin, polystyrene sulfonic acid, polyethylene glycol, poly(meth)acrylic acid, poly(meth) acrylic acid, alkali metal salts of polyacrylic acid, crosslinked copolymers containing (meth)acrylic acid or alkali metal salts of (meth)acrylic acid, alkali metal salts of polystyrene sulfonic acid, dextran, carrageenan and the like. Anti-static coatings such as those described in EP 440,957 can be incorporated in the intermediate layer. This results both in a higher hydrophilicity and in better anti-static properties.

The intermediate layer may further comprise polymeric dispersions or latices, surfactants, inorganic particles such as silica and colloidal silica and the like. Addition of surfactants, colloidal silica and/or latices is preferred. Addition of silica to the intermediate layer decreases sticking to the coating roll after coating. Addition of latices to the intermediate layer improves the addition and improves the removing step in the recycling process in case of acrylic acid or methacrylic acid type latices.

The intermediate layer may also have a cushioning property, such as mentioned in U.S. Pat. No. 4,734,397.

A highly preferred intermediate layer is based on polystyrene sulphonic acid, hydroxyethylcellulose and an anionic surfactant.

The support for the receiving element may be a transparant film of e.g. polyethylene terephthalate, a polyether sulfone, a polyimide, a cellulose ester, or a polyvinyl alcohol-co-acetal. The support may also be a reflective one such as baryta-coated paper, polyethylene-coated paper, or white polyester i.e. white-pigmented polyester. Blue-coloured polyethylene terephthalate film can also be used as a support.

Although the subbing layer is useful for application on polyethylene-coated paper, substrates based on polyester, transparent or reflective, are preferred. In this case, the subbing layer can be applied before, during or after the biaxial stretching procedure.

At the opposite side of the receiving element (opposite to the receiving layer), a backcoat can be provided, optionally in combination, with an appropriate subbing layer to improve the adhesion between the backcoat and the support.

Hydrophilic as well as hydrophobic backcoats can be used. Hydrophilic backcoats can be applied easily from water, white hydrophobic backcoats have the advantage that the backcoat performs well at all humidity levels.

Examples of hydrophilic backcoat layers are layers comprising polyvinylalcohol, polyethylene glycol, polyacrylamide, hydroxyethylcellulose, dextran and gelatin. The use of gelatin is highly preferred.

These hydrophilic backcoat layers may further comprise dispersions or latices of hydrophobic polymers, inorganic particles, surfactant and the like. The addition of these particles can be used in order to obtain a specific surface gloss, such as mentioned in EP-A-543441. Especially preferred particles are silica and polymethylmethacrylate beads of 0.5 to 10 $\mu$m. Antistatic treatment can also be provided to said backcoat layer.

Examples of hydrophobic backcoat layers are backcoat layers comprising addition polymers such as polymethylmethacrylate, polyvinylchloride and polycondensates such as polyesters, polycarbonates in combination with the above mentioned particles for the hydrophilic backcoat layers.

With hydrophobic backcoat layers, it can be useful to provide an intermediate hydrophilic layer between the subbing layer and the backcoat layer, such as those mentioned for use at the receiving side of the receiving element, in order to improve the removal of the backcoat layer in the recycling procedure.

The donor element, for use in combination with the receiving element of the present invention comprises on a support a donor layer comprising a binder and a thermotransferable reducing agent capable of reducing a silver source to metallic silver upon heating.

Examples of suitable reducing agents are aminohydroxycycloalkenone compounds, esters of amino reductones, N-hydroxyurea derivatives, hydrazones of aldehydes and ketones, phosphoramidophenols, phosphoramidoanilines, polyhydroxybenzenes, e.g. hydroquinone, t-butylhydroquinone, isopropylhydroquinone, and (2,5-dihydroxyphenyl)methylsulfone, pyrocatechol, 4-phenylpyrocatechol, t-butylcatechol, pyrogallol, or pyrogallol derivatives such as pyrogallol ethers or esters, 3,4-dihydroxybenzoic acid, 3,4-dihydroxybenzoic acid esters such as dihydroxybenzoic acid, methyl ester, ethyl ester, propyl ester, butyl ester and the like, gallic acid, gallic acid esters such as methyl gallate, ethyl gallate, propyl gallate and the like, gallic acid amides, sulfhydroxamic acids, sulfonamidoanilines, 2-tetrazolylthiohydroquinones, e.g., 2-methyl-5-(1-phenyl-5-tetrazolylthio)hydroquinone, tetrahydroquinoxalines, e.g. 1,2,3,4-tetrahydroquinoxaline, amidoximes, azines, hydroxamic acids, 5-pyrazolones, sulfonamidophenol reducing agents, 2-phenylindan-1,3-dione and the like, 1,4-dihydropyridines, such as 2,6-dimethoxy-3,5-dicarbethoxy-1,4-dihydropyridine, bisphenols, e.g., bis(2-hydroxy-3-t-butyl-5-methylphenyl) methane, bis(6-hydroxy-m-toly)mesitol, 2,2-bis (4-hydroxy-3-methylphenyl)propane, 4,4-ethylidene-bis(2-t-butyl-6-methylphenol) and 2,2-bis(3,5-dimethyl-4-hydroxyphenyl) propane, ascorbic acid derivatives and 3-pyrazolidones.

Reducing agents having a coloured oxidation product or wherein the oxidation product is capable of forming colour can also be used. Examples are 4-methoxynaphthol and leucoazomethines such as mentioned in European Patent Application no 94200613.

Reducing agents selected from the group of pyrocatechol, pyrocatechol derivatives, gallol and gallolderivatives and leucoazomethines are preferred. Especially preferred strong reducing agents are 4-phenylpyrocatechol and its derivatives, alkyl galates and 3.4-dihydrobenzoates.

Two or more reducing agents can be used in the donor layer. It may be advantageous to use a thermotransferrable dye in combination with said strong reducing agent. This is especially useful when black images having a neutral grey tone are required, e.g. in medical applications. The principle of the use of thermotransferable dyes is explained in more detail in European Patent Application no 94200796.

As a binder for the donor layer, hydrophilic or hydrophobic binders can be used, although the use of hydrophobic binders is preferred.

Hydrophilic binders that can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derivated from acrylats and acrylate derivatives, such as polymethyl metahcrylate and styrene-acrylate copolymers; polyester resins; polycarbonates; copoly(styrene-co-acrylonitrile); polysulfones; polyphenylene oxide; organosilicones, such as polysiloxanes; epoxy resins and natural resins, such as gum arabic. Preferably, the binder for the donor layer of the present invention comprises poly(styrene-co-acrylonitrile).

The binder for the donor layer preferably comprises a copolymer comprising styrene units and acrylonitrile units, preferentially at least 60% by weight of styrene units and at least 25% by weight of acrylonitrile units binder. The binder copolymer may, of course, comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is, of course, possible to use a mixture of the copolymer comprising styrene units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 μm, and the amount ratio of reducing agent to binder generally ranges from 9:1 to 1:10 weight, preferably from 3:1 to 1:5 by weight.

The donor layer may also contain other additives such as i.a. thermal solvents, stabilizers, curing agents, preservatives, dispersing agents, antistatic agents, defoaming agents, and viscosity-controlling agents.

The stabilisers used in accordance with the present invention can be incorporated in the donor layer, provided they transfer at least partially to the receiving element during image-wise heating or during overall heating with a separate region of the donor element.

The donor layer may also contain particles protruding from the surface of the donor element, such as described in European Patent Application no 94200788.

Highly preferred particles for use in connection with the present invention are polymethylsilylsesquioxane particles such as e.g. Tospearl™ 120, Tospearl™ 130 and Tospearl™ 145 (Toshiba Silicone). In case a laser is used to heat the donor layer of the donor element, an infra-red absorbing substance is advantageously added to one of the layers of the donor element, preferably to the donor layer.

Any material can be used as the support for the donor element provided it is dimensionally stable and capable of withstanding the temperatures involved. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, suitable supports for use in combination with a thermal head can have a thickness of 2 to 30 μm, preferably a thickness of 4 to 10 μm is used. The thickness of the support for image-wise heating with a laser is less critical. Usually a thicker support of 30 to 300 μm is used. The support may also be coated with an adhesive of subbing layer, if desired.

Subbing layers comprising aromatic copolyesters, vinylidene chloride copolymers, organic titanate, zirconates and silanes, polyester urethanes and the like can be used.

The donor layer of the donor element can be coated on the support or printed thereon by a printing technique such as a gravure process.

A barrier layer comprising a hydrophilic polymer may also be employed between the support and the donor layer of the donor element to enhance the transfer of reducing agent by preventing wrong-way transfer of reducing agent backwards to the support. The barrier layer may contain any hydrophilic material that is useful for the intended purpose. In general, good results can be obtained with gelatin, polyacrylamide, polyisopropyl acrylamide, butyl methacrylate-grafted gelatin, ethyl methacrylate-grafted gelatin, ethyl acrylate-grafted gqelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid.

Certain hydrophilic polymers e.g. those described in EP 227,091 also have an adequate adhesion to the support and the layer, so that the need for a separate adhesive or subbing layer is avoided. These particular hydrophilic polymers used in a single layer in the donor element thus perform a dual function, hence are referred to as barrier/subbing layers. The back side of the donor element for image-wise heating with a laser is not critical. Typically a transparant coating is used, incorporating particles to enhance the transport properties.

Owing to the fact that the thin support softens when heated by a thermal head during the printing operation and then sticks to the thermal printing head, thereby causing malfunction of the printing apparatus and reduction in image quality, the back of the support (the side opposite to that carrying the donor layer) is preferably provided with a heat-resistant layer to facilitate passage of the donor element past the thermal printing head. An adhesive layer may be provided between the support and the heat-resistant layer.

Any heat-resistant layers known in the field of thermal sublimation printing or wax printing can be used in the present invention.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 92/128,899 or a polymeric thermoplast as described in e.g. EP 267,469, JP 58/187,396, JP 63/191,678, JP 63/191,679, JP 01/234,292, and JP 02/70,485.

During printing, a smooth transport of the donor ribbon and the receiving element is required in order to obtain a good density uniformity all over the print.

It is preferred to use different types of lubricants to allow continuous transport of the donor ribbon relative to the thermal head.

Well known lubricants are polysiloxanes such as those mentioned in EP 267,469. U.S. Pat. No. 4,738,950, U.S. Pat. No. 4,866,028, U.S. Pat. No. 4,753,920 and U.S. Pat. No. 4,782,041. Especially useful slipping agents are polysiloxane-polyether block or graft polymers.

Other lubricants for the heat-resistant slipping layer of the donor element are phosphoric acid derivatives such as those mentioned in EP 153,880 and EP 194,106, metal salts of long fatty acids (such as mentioned in EP 458,538, EP 458,522, EP 314,348, JP 01/241,491 and JN 01/222,993), wax compounds such as polyolefin waxes such as e.g. polyethylene or polypropylene wax, carnauba wax, bees wax, glycerine monostearate, amid wax such as ethylene bisstearamide and the like.

A heat-resistant layer such as mentioned in European Patent Application no. 93 202 050.6 is especially preferred.

Inorganic particles such as salts derived from silica such as e.g. talc, clay, china clay, mica, chlorite, silica, or carbonates such as calcium carbonate, magnesium carbonate or calcium magnesium carbonate (dolomite) can be further added to the heat-resistant layer.

It is highly preferred to add mixtures of particles to the heat resistant layer having a Mohs hardness below 2.7 and particles having a Mohs hardness above, 2.7 such as mentioned in EP-A-93201642.1.

A mixture of talc and dolomite particles is highly preferred.

A particular heat-resistant layer for the present invention comprises as a binder a polycarbonate derived from a bis-(hydroxyphenyl)-cycloalkane, corresponding to general formula (II):

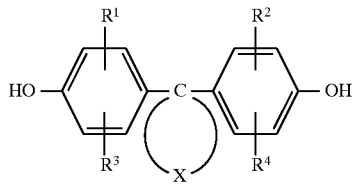

(II)

wherein:

$R^1$, $R^2$, $R^3$, and $R^4$ each independently represents hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, optionally substituted with a $C_1$–$C_6$ alkyl group, a 5- or 6-membered cycloalkyl group or a fused-on 5- or 6-membered cycloalkyl group, as lubricants polyether modified polysiloxane block copolymer and zinc stearate and as particles talc particles with a mean size of 4.5 $\mu$m.

Lubricants and binder can be coated in a single layer, or can be casted in a separate layer. It is highly preferred to cast the salt of a fatty acid in the heat resistant layer (e.g. as a dispersion) and the polysiloxane based lubricant in a separate topcoat. This separate topcoat is preferably casted from a non-solvent for the heat-resistant layer.

The heat-resistant layer of the donor element may be coated on the support or printed thereon by a printing technique such as a gravure printing.

The heat-resistant layer thus formed has a thickness of about 0.1 to 3 $\mu$m, preferably 0.3 to 1.5 $\mu$m.

Preferably a subbing layer is provided between the support and the heat-resistant layer to promote the adhesion between the support and the heat-resistant layer. As subbing layer any of the subbing layers known in the art for dye-donor elements can be used. Suitable blinders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly (vinylidene chloride-co-acrylonitrile). Suitable subbing layers have been described in e.g. EP 138,483, EP 227,090, EP-A-564010, U.S. Pat. No. 4,567,113, U.S. Pat. No. 4,572,860, U.S. Pat. No. 4,717,711, U.S. Pat. No. 4,559,273, U.S. Pat. No. 4,695,288, U.S. Pat. No. 4,727,057. U.S. Pat. No. 4,737,486, U.S. Pat. No. 4,965,239, U.S. Pat. No. 4,753,921, U.S. Pat. No. 4,895,830, U.S. Pat. No. 4,929,592, U.S. Pat. No. 4,748,150, U.S. Pat. No. 4,965,238, and U.S. Pat. No. 4,965,241.

Although in accordance with the most preferred embodiment of this invention, the stabiliser is added to the image receiving element, the stabiliser may instead or additionally be comprised in a layer of the donor element, e.g. the layer comprising the reducing agent(s). The stabiliser, which in this case should be thermotransferable, will thus be image-wise transferred together with the reducing agent(s) to the image receiving element. A disadvantage of this embodiment is the fact that only a small amount of stabiliser will be transferred at the low density parts of the images. Therefore, when the stabiliser is only added to the donor element, it is preferred to use a donor element having a donor layer comprising at least two frames wherein one of the frames comprises the stabiliser and the other comprises a reducing agent. With the latter type of donor element, the stabiliser may be transferred to the image receiving element in a separate (image-wise) heating pass of the assemblage of donor and receiving element.

The receiving element of the present invention is preferably heated in contact with the donor element using a thermal head to selectively heat specific portions of the donor element in contact with a receiving element. The thermal head can be a thick or thin film thermal head although the use of a thin film thermal head is preferred, since this offers more opportunities to obtain appropriate gradation. The pressure applied to the thermal head is preferably between 120 and 400 g/cm heater line. A spatial resolution of 150 dpi or higher is preferred. The average printing power is calculated as the total amount of energy applied during one line time divided by the line time and by the surface area of the heat-generating elements.

Although a higher average printing power results in higher optical densities of the final image, is is preferred to use an average printing power below 10 W/mm$^2$. At higher printing energies, deformation of the receiving layer and/or receiving sheet occurs.

The time needed for printing one single line with the thermal head, also called the line time, is preferably below 45 ms. Longer line times result in longer printing times and more deformation of the receiving sheet and/or receiving layer.

In order to increase the density of the final image after printing line-by-line with a thermal head, an overall heat treatment of the receiving element may be performed. This heat treatment can be e.g. done with an infrared source, a heated air stream or a hot plate but is preferably done by means of a heated roller.

It is believed that during the overall heat treatment, the transferred reducing agent can further react with the reducible silver source.

By selecting the appropriate diameter and speed of the heated roller, the heat treatment time for the overall heating can be adjusted. Moreover, the heated rollers can be used to uncurl the receiving sheet after printing.

The following examples illustrate the invention in more detail without, however, limiting the scope thereof.

EXAMPLES

Preparation of the Donor Elements

Donor element A

Both sides of a 5.7 μm thick polyethylene terephthalate support were coated with a subbing layer of a copolyester comprising ethylene glycol, adipic acid, neopentyl glycol, terephthalatic acid, isophthalic acid, and glycerol.

The resulting subbing layer was covered with a solution in methyl ethyl ketone of 13% of a polycarbonate having the following structural formula (X):

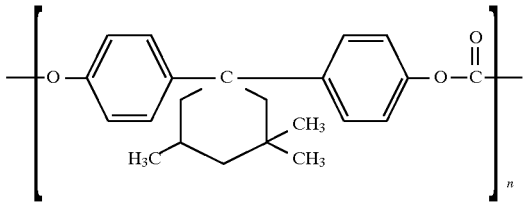

wherein n represents the number of units to obtain a polycarbonate having a relative viscosity of 1.30 as measured in a 0.5% solution in dichloromethane, 0.5% of talc (Nippon Talc™ P3, Interorgana) and 1.5% of zinc stearate, 0.2% of dolomite (Microdol Super™, Norwegian Talc) and 0.5% of Tegoglide™ 410 (Goldschmidt).

The other side of the donor element was provided with a donor layer.

A mixture of 10 weight % binder (Luran™ 388S, BASF), 8 weight % 4-phenylpyrocatechol, 5 weight % of propylgallate, 2% of a cyan dye having a structural formula XI:

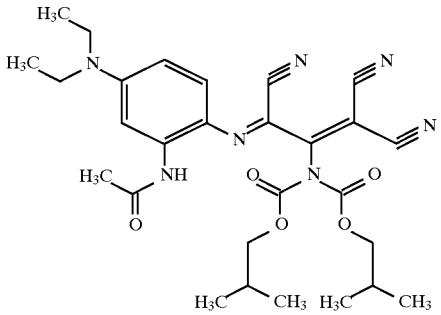

and 0.5% Tospearl™ 145 (Toshiba Silicone) was applied at a wet thickness of 10 μm by means of a wire bar. The resulting layer was dried by evaporation of the solvent.

Donor element B

The preparation as mentioned above for donor element A was repeated, except that a mixture of 3.5 weight % 4-phenylpyrocatechol, 2.5% Tospearl™ 145 was used as coating liquid for the donor layer.

Preparation of the Receiving Elements

A subbed polyethylene terephthalate support having a thickness of 175 μm was coated in order to obtain the following receiving layer:

| | |
|---|---|
| silver behenate | 4.5 g/m$^2$ |
| compound mentioned above | 0.34 g/m$^2$ |
| polyvinylbutyral (Butvar ™ B79, Monsanto) | 4.5 g/m$^2$ |

weak reducing agent (type and amount in table I) stabiliser (type and amount in table I)

The receiving layers were coated with a release layer comprising 0.5 g/m$^2$ polyvinylbutyral (Butvar™ B79) and 0.05 g/m$^2$ Tegoglide™ 410 (Goldschmidt).

These receiving elements were used in the following printing examples. The amounts in table I are in g/m$^2$.

Printing of the Combination of Donor and Receiving Elements

Printing was performed by contacting the donor layer of the donor element with the receiving layer of the receiving element, followed by heating by means of a thermal head.

The thermal head was a thin film thermal head heated at an average printing power of 5 Watt/mm$^2$ and a line time of 18 ms with a resolution of 300 dpi. The pressure applied between the thermal head and the rotating drum carrying the receiving and donor element was 160 g/cm heater line. After printing, the receiving element was separated from the donor element.

The printed image was a 16-step grey scale between data level 0 and 255 (8 bit). The data levels of the different steps were choosen equidistant with respect to the input data level in order to obtain the native sensitometry.

Overall Heat Treatment

All receiving elements were reheated on a hot plate of 118° C. for 5 seconds.

Stability

The stability of the final image at elevated temperatures was evaluated after storage at 45° C./70% relative humidity and/or 57° C./34% relative humidity) for 7 days.

The stability upon exposure to light was evaluated after 24 hours illumination by means of a Suntest equipment Hereaus.

The degree of discoloration (getting brown) was evaluated visually.

The following criteria were used:

(E) Excellent: The image preserves a neutral grey tone (G) Good: The image has only a slight brownish shade.

(M) Moderate: The image has a clearly visible brown color tone.

(B) Bad: The image has become completely brown.

TABLE I

| Weak reducing agent | | Stabiliser | | Donor | Stability | | |
|---|---|---|---|---|---|---|---|
| Type | Amount | Type | Amount | element | 45° C. | 57° C. | Suntest |
| None | — | None | — | A | M | B | M |
| R3 | 3 | None | — | B | M | B | M |
| R11 | 2 | None | — | B | M | B | B |
| R6 | 2 | None | — | B | M | B | E |
| None | — | XIX | 0.12 | A | — | E | E |
| None | — | XIX | 0.30 | A | — | E | E |
| None | — | I | 0.06 | A | — | G | G |
| None | — | I | 0.30 | A | — | E | E |
| None | — | I | 0.65* | A | E | — | E |
| None | — | II | 0.16 | A | — | G | E |
| None | — | III | 0.65 | A | — | G | E |
| None | — | X | 0.32 | A | — | G | E |
| R11 | 2.5 | XXI | 0.16 | B | G | M | G |
| R11 | 2.5 | XXII | 0.16 | B | G | M | G |
| R11 | 2.5 | XXIII | 0.16 | B | G | M | G |
| R11 | 2.5 | XXIII | 0.65 | B | G | M | G |
| R11 | 2.5 | XXIV | 0.16 | B | G | M | G |
| R11 | 2.5 | XXV | 0.03 | B | E | G | M |
| R11 | 2.5 | XXV | 0.06 | B | E | G | M |
| R11 | 2.5 | XXV | 0.14 | B | E | G | M |
| R11 | 2.5 | VIII | 0.16 | B | E | G | E |
| R11 | 2.5 | IX | 0.16 | B | E | G | E |
| R3 | 3 | I | 0.65* | B | G | M | G |

*The compound was codispersed with the silver behenate in a ball-milling process.

It is clear from table I that the receiving elements containing a stabiliser perform better than a receiving element without such stabiliser. The stability at higher temperatures as well as the stability upon exposure to light is better due to the use of specific stabilisers in the receiving element of the present invention.

We claim:

1. A substantially non-photosensitive thermal imaging system consisting of (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indinolines, 1,3-dinitroaryl compounds, 1,2,3-triazoles, phthalic acids and phthalic acid derivatives.

2. A thermal imaging system according to claim 1 wherein said stabiliser is present at a coverage of 0.05 to 2 g per square meter.

3. A thermal imaging system according to claim 1, wherein the receiving layer further comprises a toning agent.

4. A thermal imaging system according to claim 1 wherein the receiving layer further comprises a weak reducing agent.

5. A thermal imaging system according to claim 1 wherein said stabiliser is a 3,4 dialkoxy substituted benzotriazole.

6. A substantially non-photosensitive thermal imaging process using (i) a donor element comprising on a support a donor layer containing a binder and a thermotransferable reducing agent capable of reducing a silver source to metallic silver and (ii) a receiving element comprising on a support a receiving layer comprising a silver source, capable of being reduced by means of heat in the presence of a reducing agent, a binder and a stabiliser selected from the group consisting of benzotriazoles, heterocyclic mercaptanes, sulphinic acids, 1,3,4-triazo-indolizines, 1,3-dinitroaryl compounds, 1,2,3-triazoles, phthalic acids and phthalic acid derivatives, said thermal imaging process comprising the steps of bringing said donor layer of said donor element into face to face relationship with said receiving layer of said receiving element, image-wise heating a thus obtained assemblage, thereby causing image-wise transfer of an amount of said thermotransferable reducing agent from the donor element to said receiving element in accordance with the amount of heat supplied and separating said donor element from said receiving element.

7. A thermal imaging process according to claim 6, wherein the receiving layer further comprises a toning agent.

8. A thermal imaging process according to claim 6 wherein the receiving layer further comprises a weak reducing agent.

9. A thermal imaging process according to claim 6 wherein said receiving element after said image-wise heating is overall heated.

10. A thermal imaging process according to claim 9 wherein said overall heating is performed by means of a heated roller.

11. A thermal imaging process according to claim 7 wherein the receiving layer further comprises a weak reducing agent.

* * * * *